US006918496B1

(12) United States Patent
Henson, III

(10) Patent No.: US 6,918,496 B1
(45) Date of Patent: Jul. 19, 2005

(54) COLLAPSIBLE SHELF ASSEMBLY HAVING ADJUSTABLE HOLDING STRAP FOR CONTAINERS

(76) Inventor: George A. Henson, III, 328 Rockledge La., Manitou Springs, CO (US) 80829

( * ) Notice: Subject to any disclaimer, the term of this patent is extended or adjusted under 35 U.S.C. 154(b) by 140 days.

(21) Appl. No.: 10/411,180

(22) Filed: Apr. 10, 2003

Related U.S. Application Data

(60) Provisional application No. 60/372,404, filed on Apr. 15, 2002.

(51) Int. Cl.[7] ..... A47F 7/00

(52) U.S. Cl. ..... 211/153; 211/90.01; 211/86.01; 108/47; 108/152; 248/248

(58) Field of Search ..... 211/135, 90.01, 211/153, 133.6, 126.5, 126.16, 86.01, 119.003; 108/47, 152; 248/247, 248

(56) References Cited

U.S. PATENT DOCUMENTS 2,586,524 A * 2/1952 Dussardier ..... 312/231
2,622,834 A * 12/1952 Sparring ..... 248/243
2,746,202 A * 5/1956 Barker ..... 211/74
2,867,928 A * 1/1959 Angell ..... 206/1.8
3,389,945 A * 6/1968 Thomas ..... 312/231
3,965,826 A * 6/1976 Markham ..... 108/152
5,133,463 A * 7/1992 Merl ..... 211/190
5,205,524 A * 4/1993 Cohen ..... 248/235
5,257,721 A * 11/1993 Smith et al. ..... 220/533
5,722,329 A * 3/1998 Weng ..... 108/47
6,206,183 B1 * 3/2001 Helsel ..... 206/1.7
6,240,857 B1 * 6/2001 Elizer ..... 108/152

* cited by examiner

*Primary Examiner*—Robert W. Gibson, Jr.
(74) *Attorney, Agent, or Firm*—G. F. Gallinger

(57) ABSTRACT

A shelf constructed from lightweight sheet metal, which can be used in conjunction with a "French" type box easel, and carried and stored within the box of the easel. The shelf itself maintains a shelf supporting arm in an upright plane so that a holding end of the arm is able to support a vertical load from one and only one arm supporting hook thereon. The shelf assembly comprises: a horizontal shelf member having a vertically extending portion(s) having two vertically extending openings therein; two support arms each having a rear end portion having one, and only one rear hook extending from a top portion thereof, a longitudinal horizontal top side portion to carry the shelf member, and a vertically extending projection adapted to be closely received within the openings in the shelf member. When the arms are received in the shelf member the arms are maintained in an upright position and the shelf assembly is thereby stable under load when hung on and over the support.

16 Claims, 1 Drawing Sheet

COLLAPSIBLE SHELF ASSEMBLY HAVING ADJUSTABLE HOLDING STRAP FOR CONTAINERS

PRIOR APPLICATION

This application claims the priority of Provisional Application No. 60/372,404, filed Apr. 15, 2002.

FIELD OF INVENTION

This invention relates to collapsible lightweight shelves. More particularly this invention relates to a shelf constructed from lightweight sheet metal. The shelf itself maintains a shelf supporting arm in an upright plane so that a holding end of the arm is able to support a vertical load from one and only one arm supporting hook thereon.

BACKGROUND OF THE INVENTION

The inventor is a painter who uses a "French" type box easel which comprises a relatively flat wooden box having a sliding wooden drawer therein. The box is fitted with folding telescoping legs. A top side portion of the box is hinged to the box on one end portion thereof and the other opposite end portion thereof may be lifted to a near vertical position where it can be secured to provide a support for a workpiece or surface which is to be crafted. When the cover is lifted to an operative position the drawer of the box is slid open to access craft materials which are typically stored therein. With this arrangement an artist or painter is able to conveniently transport all of his equipment, housed within the box easel to various locations. On location, the artist or painter erects the easel, lifts and secures the top side portion of the box in an upright position, supports his workpiece thereon, and opens the drawer to access the paints and brushes. One problem with this approach is that the opened drawer which is full of painting equipment provides insufficient working space. Additional shelf space, adjacent to the workpiece is needed for mixing paints and supporting equipment. What is needed is a lightweight shelf which can hang from the easel drawer and which can be broken down so that it can be stored within, and conveniently transported with the easel box.

OBJECTS OF THE INVENTION

It is an object of this invention to disclose a rugged lightweight shelf assembly. It is an object of this invention to disclose a shelf assembly which can be readily broken down for compact storage and transport. It is yet a further object of this invention to disclose a shelf assembly which is designed to hang in a working position from a "French" type box easel having an open drawer, and to be stored and carried when disassembled within the closed drawer in the box of the easel. It is a final object of this invention to disclose a shelf assembly which includes an adjustable strap which securely carries containers of varying sizes.

One aspect of this invention provides for a shelf assembly adapted to hang on and over a support comprising: a horizontal shelf member having a vertically extending portion(s) having two vertically extending openings therein; two support arms each having a rear end portion having one, and only one rear hook extending from a top portion thereof, a longitudinal horizontal top side portion to carry the shelf member, and a vertically extending projection adapted to be closely received within the openings in the shelf member. When the arms are received in the shelf member the arms are maintained in an upright position and the shelf assembly is thereby stable under load when hung on and over the support.

In a preferred aspect of the invention the support arms and the shelf member are formed from sheet metal. The vertically extending portion comprises a folded front edge portion having vertical slots therein to receive the vertical arm projections.

A method of providing a collapsible shelf for use with a "French" type box easel comprising the steps of: a) providing a horizontal shelf member having a vertically extending portion(s) having two vertically extending openings therein; b) providing two support arms each having a rear end portion having one, and only one rear hook extending from a top portion thereof, a longitudinal horizontal top side portion to carry the shelf member, and a vertically extending projection adapted to be closely received within the openings in the shelf member; c) positioning the arms in the shelf member so that they are maintained in an upright position and the shelf assembly is thereby stable under load; and, d) hanging the assembled shelf assembly on and over a side portion of the opened easel.

Various other objects, advantages and features of this invention will become apparent to those skilled in the art from the following description in conjunction with the accompanying drawings.

FIGURES OF THE INVENTION

Figure 1:
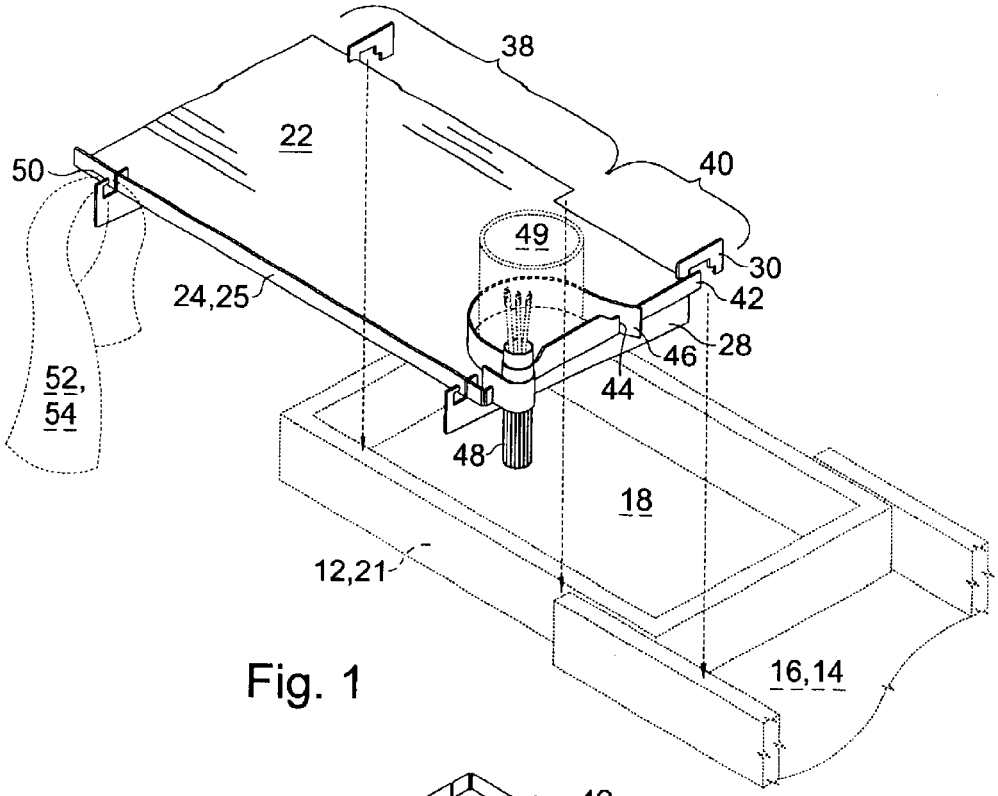
FIG. 1 is a perspective view of an assembled shelf assembly, positioned to hang on a side portion of an open drawer and box of a "French" type box easel.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
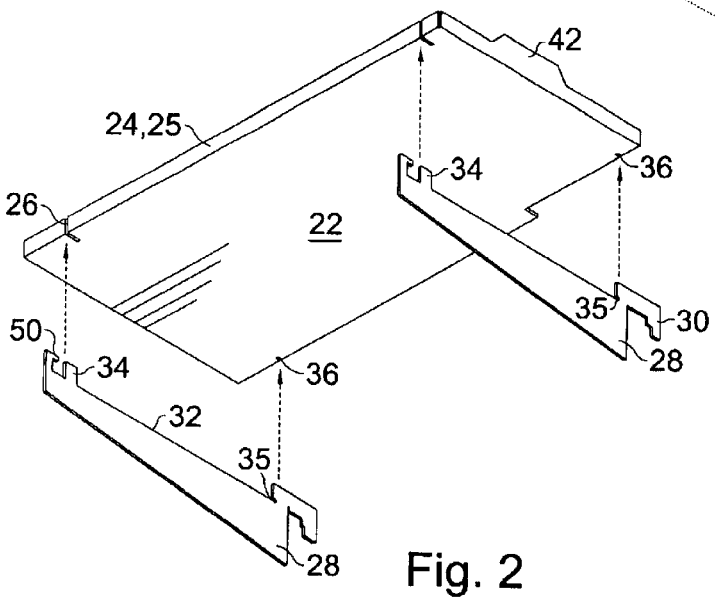
FIG. 2 is an exploded perspective view looking up at the bottom side portion of the shelf assembly shown in FIG. 1.

Turning now to the drawings and more particularly to FIG. 1 we have a perspective view of an assembled shelf assembly 20, positioned to hang the side portion of an open drawer 18 and box 16 of a "French" type box easel 14. FIG. 2 is an exploded perspective view looking up at the bottom side portion of the shelf assembly 20 shown in FIG. 1. The shelf assembly 20 adapted to hang on and over a support 12 comprises: a horizontal shelf member 22 having a vertically extending portion(s) 24 having two vertically extending openings 26 therein; two support arms 28 each having a rear end portion having one, and only one rear hook 30 extending from a top portion thereof, a longitudinal horizontal top side portion 32 to carry the shelf member 22, and a vertically extending projection 34 adapted to be closely received within the openings 26 in the shelf member 22. When the arms 28 are received in the shelf member 22 the arms 28 are maintained in an upright position and the shelf assembly 20 is stable under load when hung on and over the support 12.

Most preferably the support arms 28 and the shelf member 22 of the shelf assembly 20 are formed from sheet metal which is aluminum. The vertically extending portion 24 most preferably comprises a folded front edge portion 25 having vertical slots 26 therein to receive the arm projections 34. The rear edge portion of the shelf member 22 most preferably also has openings 36. The corresponding rear portions of the arms 28 also have rear projections 35 which are received in the rear openings 36 to provide more secure mounting of the shelf member 22 on the arms 28.

To facilitate hanging the shelf assembly 20 on and over the side portion 21 of an opened "French" type box easel 14, the shelf assembly 20 has a drawer end portion 38 and a box end portion 40. The box end portion 40 of the shelf assembly 20 is indented in width so that it may be hung over and on the box 16 of the easel 14 while the drawer end portion 38 of the shelf assembly 20 is hanging adjacent to the drawer 18 which is projecting from the box 16.

In a preferred embodiment of the invention the box end portion 40 has an upturned end edge portion 42. If two spaced vertical slots 44 are provided in a flexible and resilient strap 46, the slots 44 then can be positioned over the upturned edge portion 42. When the strap 46 is bent and the slots 44 are positioned over the upturned edge portion 42 then a liquid container 49 can be seated on the shelf member 22 closely between the upturned edge portion 42 and the strap 46. In the most preferred embodiment of the invention the strap 46 has three spaced vertical slots 44 partially therethrough. Then the three vertical slots 44 are received over the upturned edge portion 42 when the strap is bent in an S shape. In this case, as with two slots 44, a liquid container 49 may be seated on the shelf member 22 and another brush container 48 may be hung between the strap 46 and the upturned edge portion 42 adjacent to the shelf member 22.

In the most preferred embodiment of the invention at least one of the arms 28 has an upturned rag hook 50 on a front end portion thereof to hang painting paraphernalia 52 thereon. It is contemplated such paint paraphernalia 52 might include a rag 54 and a plastic trash sac (not shown). In the most preferred embodiment of the invention the shelf assembly 20 is dimensioned so that when it is disassembled it may be carried and stored within the "French" type box easel 14.

A method of providing a collapsible shelf assembly 20 for use with a "French" type box easel 14 comprises the steps of: a) providing a horizontal shelf member 22 having a vertically extending portion(s) 24 having two vertically extending openings 26 therein; b) providing two support arms 28 each having a rear end portion having one, and each having only one rear hook 30 extending from a top portion thereof, a longitudinal horizontal top side portion 32 to carry the shelf member 22, and a vertically extending projection 34 adapted to be closely received within the openings 26 in the shelf member 22; c) positioning the arms 28 in the shelf member 22 so that they are maintained in an upright position and the shelf assembly 20 is thereby stable under load; and, d) hanging the assembled shelf assembly 20 on and over a side portion 21 of the opened easel 14. This general method may be adopted with the specifics cited shelf assembly 20.

While the invention has been described with preferred specific embodiments thereof, it will be understood that this description is intended to illustrate and not to limit the scope of the invention, which is defined by the following claims.

I claim:

1. A shelf assembly adapted to hang on and over a support comprising:

a horizontal shelf member having a vertically extending front portion having two vertically extending openings therein and a rear edge portion having arm openings therein;

two support arms each having a rear end portion having one, and only one rear hook extending from a top portion thereof, a longitudinal horizontal top side portion to carry the shelf member, and a vertically extending front projection adapted to be closely received within the front portion vertical openings in the shelf member each support arm also having a rear projection corresponding and adapted to be received in the rear edge portion opening of the shelf member to thereby provide more secure mounting of the shelf member on the arms;

so that when the arms are received in the shelf member, the arms are maintained in an upright position and the shelf assembly is thereby stable under load, when hung on and over the support.

2. A shelf assembly as in claim 1 wherein the support arms are formed from sheet metal.

3. A shelf assembly as in claim 2 wherein the shelf member is formed from sheet metal and wherein the vertically extending portion comprises a folded front edge portion having vertical slots therein to receive the vertical arm projections.

4. A shelf assembly as in claim 1 adapted to hang on and over the side portion of an opened "French" box easel wherein the shelf assembly has a drawer end portion and a box end portion and wherein the box end portion of the shelf assembly is indented in width so that it may be hung over and on the box of the easel while the drawer end portion of the shelf assembly is hanging adjacent to the drawer which is projecting from the box.

5. A shelf assembly as in claim 4 wherein the shelf member has an upturned end edge portion and further comprises a flexible and resilient strap having two vertical slots partially therethrough which are received over the upturned edge portion so that when the strap is bent and the slots therein are positioned over the upturned edge portion a liquid container may be seated on the shelf member closely between the upturned edge portion and the strap.

6. A shelf assembly as in claim 4 wherein the shelf member has an upturned end edge portion and further comprises a flexible and resilient strap having three vertical slots partially therethrough which are received over the upturned edge portion so that when the strap is bent in an S shape and the slots therein are positioned over the upturned edge portion a liquid container may be seated on the shelf member closely between the upturned edge portion and the strap, and another brush container may be hung between the strap and the upturned edge portion adjacent to the shelf member.

7. A shelf assembly as in claim 4 wherein one of the arms has an upturned rag hook on a front end portion thereof to hang painting paraphernalia thereon.

8. A shelf assembly as in claim 4 which is dimensioned so that when it is disassembled it may be carried and stored within the "French" type box easel.

9. A method of providing a collapsible shelf for use with a "French" type box easel comprising the steps of:

a) providing a horizontal shelf member having a vertically extending front portion having two vertically extending openings therein and a rear edge portion having arm openings therein;

b) providing two support arms each having a rear end portion having one, and only one rear hook extending from a top portion thereof, a longitudinal horizontal top side portion to carry the shelf member, and a vertically extending front projection adapted to be closely received within the front portion vertical openings in the shelf member, each support arm also having a rear projection corresponding and adapted to be received in the rear edge portion opening of the shelf member to thereby provide more secure mounting of the shelf member on the arms;

c) positioning the arms in the shelf member and the the rear projections in the rear slots to provide more secure mounting of the shelf member on the arms, so that the arms are maintained in an upright position and the shelf assembly is thereby stable under load; and, d) hanging the assembled shelf assembly on and over a side portion of the opened easel.

10. A method as in claim 9 wherein the support arms are formed from sheet metal.

11. A method as in claim 10 wherein the shelf member is formed from sheet metal and wherein the vertically extending portion comprises a folded front edge portion having vertical slots therein and further comprising the step of positioning the arm projections within the vertical slots.

12. A method as in claim 11 wherein the shelf assembly has a drawer end portion and a box end portion and wherein the box end portion of the shelf assembly is indented so that it may be hung over and on the box of the easel while the drawer end portion of the shelf assembly is hanging adjacent to the drawer which is projecting from the box.

13. A method as in claim 12 wherein the box end portion has an upturned edge portion having two spaced vertical slots therethrough and further comprises a flexible and resilient strap having a lateral side portion which is received in the vertical slots when the strap is bent so that a container may be seated on the shelf member closely between the upturned edge portion and the strap.

14. A method as in claim 12 wherein the box end portion has an upturned edge portion having three spaced vertical slots therethrough and further comprising a flexible and resilient strap having a lateral side portion which is received in the vertical slots when the strap having an S shape, so that a container may be seated on the shelf member closely between the upturned edge portion and the strap and another container may be hung between the strap and the upturned edge portion adjacent to the shelf member.

15. A method as in claim 12 wherein one of the arms has an upturned rag hook on a front end portion thereof to hang painting paraphernalia on.

16. A method as in claim 12 wherein the shelf member is dimensioned so that when it is disassembled it may be carried and stored within the "French" type box easel.

* * * * *